US005282752A

United States Patent [19]

Doutrich et al.

[11] Patent Number: 5,282,752

[45] Date of Patent: Feb. 1, 1994

[54] COMBINATION CONNECTOR TOOL

[75] Inventors: Ray C. Doutrich, Lebanon; James J. Muha, State College; Stuart C. Stoner, Lewisberry, all of Pa.

[73] Assignee: E. I. Du Pont de Nemours and Company, Wilmington, Del.

[21] Appl. No.: 926,880

[22] Filed: Aug. 7, 1992

[51] Int. Cl.[5] ..... H01R 9/09

[52] U.S. Cl. ..... 439/79; 439/629; 29/739

[58] Field of Search ..... 439/55, 59-62, 439/79, 80, 83, 629; 29/739, 741, 745, 747, 764, 845

[56] References Cited

U.S. PATENT DOCUMENTS

| | | | |
|---|---|---|---|
| 3,208,026 | 9/1965 | Ruehlemann | 439/79 X |
| 3,259,876 | 7/1966 | Norden . | |
| 3,315,219 | 4/1967 | Brinser et al. . | |
| 3,576,520 | 4/1971 | Stauffer . | |
| 3,696,492 | 10/1972 | Baillard | 29/203 |
| 4,045,868 | 9/1977 | Ammon et al. | 29/629 |
| 4,050,769 | 9/1977 | Ammon . | |
| 4,156,553 | 5/1979 | Ammon et al. . | |
| 4,188,715 | 2/1980 | Ammon et al. | 29/629 |
| 4,220,393 | 9/1980 | Ammon et al. . | |
| 4,269,468 | 5/1981 | Ammon et al. . | |
| 4,330,163 | 5/1982 | Aikens et al. . | |
| 4,343,528 | 8/1982 | Lucius et al. . | |
| 4,484,792 | 11/1984 | Tengler et al. . | |
| 4,550,962 | 11/1985 | Czeschka | 439/79 X |
| 4,602,494 | 7/1986 | Carillo | 72/384 |
| 4,692,120 | 9/1987 | Feinstein | 439/62 |
| 4,735,583 | 4/1988 | Rudy, Jr. et al. | 439/350 |
| 4,767,345 | 8/1988 | Gutter et al. | 439/92 |
| 4,776,806 | 10/1988 | Adams | 439/67 |
| 4,857,017 | 8/1989 | Erk | 439/695 |
| 4,858,309 | 8/1989 | Korsunsky et al. | 29/764 |
| 4,952,172 | 8/1990 | Barkus et al. | 439/532 |
| 4,955,819 | 9/1990 | Harting et al. | 439/79 |
| 4,995,821 | 2/1991 | Casey | 439/157 |
| 5,090,920 | 2/1992 | Casey | 439/540 |

*Primary Examiner*—Larry I. Schwartz
*Assistant Examiner*—Khiem Nguyen
*Attorney, Agent, or Firm*—Woodcock Washburn Kurtz Mackiewicz & Norris

[57] ABSTRACT

The present invention relates to a tool that is useful for assembling a composite connector from a plurality of individual connectors, mounting the composite connector having a plurality of right angle tails extending therefrom into openings therefor formed in a substrate, and stiffening the substrate to prevent bowing of the same. The tool comprises a body having a plurality of slots therein. The slots are sized appropriately to receive nonremovably the tails of various forms.

16 Claims, 4 Drawing Sheets

COMBINATION CONNECTOR TOOL

BACKGROUND OF THE INVENTION

1. Field of the Invention

The present invention relates to a tool useful for assembling a composite connector from a plurality of individual connectors, mounting the composite connector having a plurality of right angle tails extending therefrom into openings therefor formed in a substrate, and stiffening the substrate to prevent bowing of the same.

2. Description of the Prior Art

FIGS. 1A and 1B are, respectively, side and rear elevational views of a prior art electrical connector C showing the same mounted to the surface of a substrate, such as a printed circuit board PCB. In the Figures the connector C is meant to represent any of the variety of connector products sold by the Electronics Department of E. I. du Pont de Nemours and Company, including the modularized header and receptacle connectors sold under the trademark Metral TM. Such Metral TM header and receptacle modules are discussed generally in the DuPont Connector Systems Product Catalog A, February, 1992, Chapter 10.

In the generalized case the connector C includes an insulating body B which carries a plurality of electrical contact terminals therein. The terminals may be signal transmission terminals of either the pin or receptacle type, bladed power terminals, and/or hybrid coaxial/-power/guide terminals. Each terminal includes a tail, generally indicated by the character T, that extends through the rear surface of the body B.

The form of each tail T varies in accordance with the type of terminal of which it is a part. The various forms of tails are best illustrated in FIG. 1B. The tail of a signal transmission terminal, whether of the pin or the receptacle type, is indicated in the Figures by the specific reference character $T_s$. A signal transmission tail $T_s$ is a generally flat beam member having a predetermined transverse dimension $D_s$. The tails $T_s$ of signal transmission terminals are usually arranged into nested groups, as is best seen in FIG. 1B. Each tail $T_s$ may be in the form of a solder tail, or, as is illustrated, have a compliant section K immediately above the tip thereof. A pushing shoulder S is spaced a predetermined distance above the compliant section K. For reasons that will become more clear herein each tail $T_s$ is provided with retention features generally indicated by the character R. In one instance, as is best illustrated in FIG. 2A, the retention feature may be configured as outwardly flaring barbs indicated by the character $R_B$. Alternatively, as is best illustrated in FIG. 2B, the retention feature takes the form of a lanced portion indicated by the character $R_L$.

The tail of a bladed power terminal is indicated in the Figures by the specific reference character $T_b$. A tail $T_b$ of a bladed power terminal is also a generally flat beam member, albeit of a more substantial nature than the signal transmission terminal. Accordingly, a tail $T_b$ exhibits a predetermined transverse dimension $D_b$ that is greater than the transverse dimension $D_s$ of the tail $T_s$ of a signal transmission terminal. The tails $T_b$ of bladed power terminals are also usually arrayed in nested groups. Similarly, bladed power terminal tails $T_b$ are provided with either the lance retention feature $R_L$ or the barbed retention feature $R_B$. Each tail $T_b$ may be in the form of a solder tail, or, as is illustrated, have a compliant section K immediately above the tip thereof.

The tail portion of a typical hybrid receptacle terminal is indicated in the Figures by the specific reference character $T_h$. A tail $T_h$ is usually a machined, block-like member having a major transverse dimension $D_h$. The block-like tail $T_h$ has an upper pushing surface U and an array of fingers F depending from the lower surface. The fingers F may also have a compliant section K. The fingers F as slightly inwardly offset from the lateral surfaces of the block. A receptacle barrel (not shown) is attached to the front of the block member. It should be understood that a stamped power receptacle such as that disclosed and claimed in copending application Ser. No. 07/843,261, filed Feb. 12, 1992 in the name of Stephen L. Clark (EL-4338) and assigned to the assignee of the present invention may be used in place of the typical hybrid receptacle terminal above described.

In typical usage the tails of the various types of terminals are inserted into openings H formed in the board PCB. This is usually a manually intensive task. To assist in this effort there is available a tool, known as a slotted push block, which is inserted over nested groups of tails and which permits an operator to push groups of the tails into the openings H. The push block is fabricated from a conductive material, and is removed from the board after after use.

U.S. Pat. Nos. 4,045,868; 4,156,553; 4,188,715; 4,220,393; and 4,269,468 disclose an electrical connector in which a portion of a housing structure is used to push tails of terminal contacts into a board.

The board PCB has, in some instances the tendency to bow. Usually this bowing is caused by heat, as during the soldering of the tails to the board, or by reaction forces imposed on the board by compliant tail sections. This is especially disadvantageous when a connector is mounted to the board using surface mount technology (SMT). In such an instance bowing may cause the connector to become separated either wholly or partially from the board. In addition, bowing is disadvantageous as it may preclude the matability of a given board with a connector mounted on another board. In some instances one or more elongated stiffening bars may be mounted to the surface of the board to overcome the tendency of the board to bow.

In view of the foregoing it is believed advantageous to provide a tool that will permit the assembly of a composite connector having a customized length from two or more modular connectors, such as Metral TM header and receptacle modules. It is also believed advantageous to provide a tool that will assist in inserting the tails of any of the various contact terminals into a substrate. It is believed to be of yet further advantage to provide such a tool that may remain in place after the insertion of the tails to serve to overcome the tendency of a board to bow.

SUMMARY OF THE INVENTION

The present invention is directed to a combination assembly-mounting-stiffening tool for assembling a composite connector from two or more individual connectors having a plurality of right angle tails extending therefrom; for assisting in inserting the tails of such a composite connector into openings provided therefor in a substrate; and for stiffening the board after insertion. The tails are arranged in nested groups and have a retention feature and a pushing shoulder thereon.

The tool comprises a body formed of an insulating material with a plurality of partitions therein. The partitions cooperate with each other to define a plurality of slots in the body. Each slot is sized to accept a group of tails. A mounting member extends from the body, preferably at at least each lateral end thereof. The tool is adapted to attach nonremovably to the tails of a connector, to secure the connector to a substrate, and when secured to the substrate to serve to stiffen the same and minimize its tendency to bow.

In a preferred arrangement the body has slots with at least two different transverse dimensions. Thus, at least some of the slots are sized to accept a tail having a first transverse dimension, while at least others of the slots are sized to accept a tail having a second transverse dimension.

In either case, when used with tails of the type having a lanced portion thereon, the body has an opening therein that accepts the lanced portion of the tail to secure nonremovably the body to the tail.

As noted, a mounting tool in accordance with the present invention may be used for a variety of mutually complementary purposes. For example, the tool in accordance with the present invention may be used to assemble a composite connector from two or more modular connectors. To this end the tool may be fabricated to any convenient length and may be sized as an integer multiple of a basic unit length of the modular connectors or to a length that is the sum of the individual unit lengths of the individual connectors being used to form the composite. Such a use is believed especially advantageous when assembling the modular header connectors or receptacle connectors sold under the trademark Metral TM header and receptacle modules. The tails of the connectors forming the composite connector are loaded into the slots in the tool. The tails are nonremovably held in the slots by engagement with the partitions defining the slots. The tool additionally provides protection from mechanical damage to the tails.

In addition, the tool may thereafter be used in the manner of a push block, to assist in the insertion of the tails into the board. To this end the partitions are provided with notches which accept pushing shoulders on the tails.

Moreover, once the tails have been inserted, the tool itself is able to be secured to the board, thereby forming a stiffening member to counteract the tendency of the board to bow.

BRIEF DESCRIPTION OF THE DRAWINGS

The invention will be more fully understood from the following detailed description, taken in accordance with the accompanying drawings, which form a part of this application and in which:

FIG. 1A is a side elevation view illustrating a generalized prior art connector having a plurality of right angle tails extending from the rear surface thereof, while

FIG. 7A is enlargement of a portion of the view of FIG. 6 with a tail of a terminal received therein, while

DETAILED DESCRIPTION OF THE INVENTION

Figure 1A:
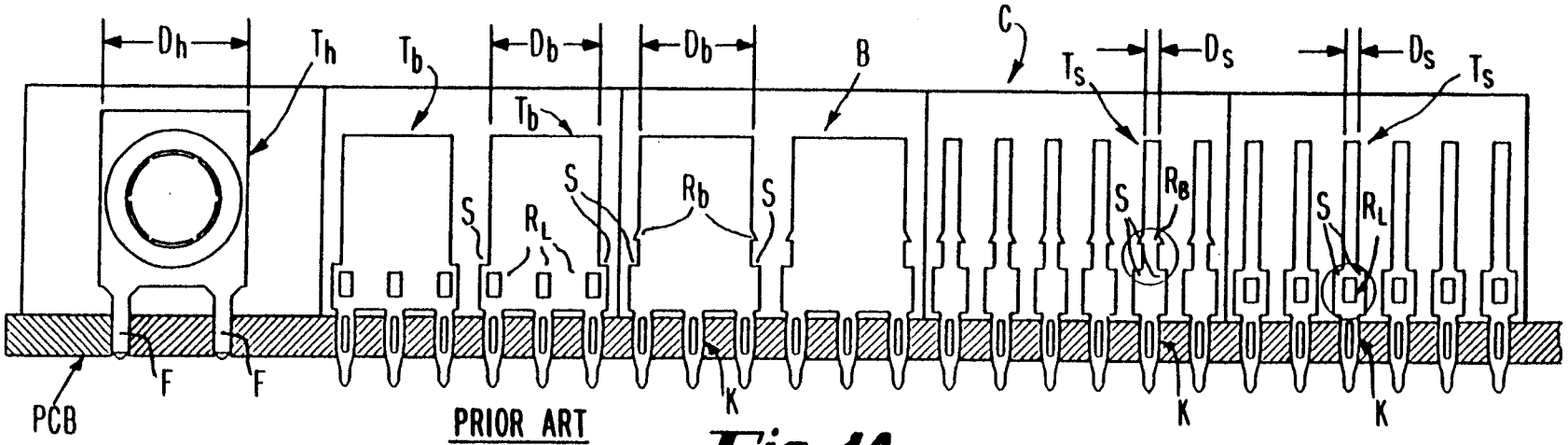
PRIOR ART Fig. 1A
Figure 1B:
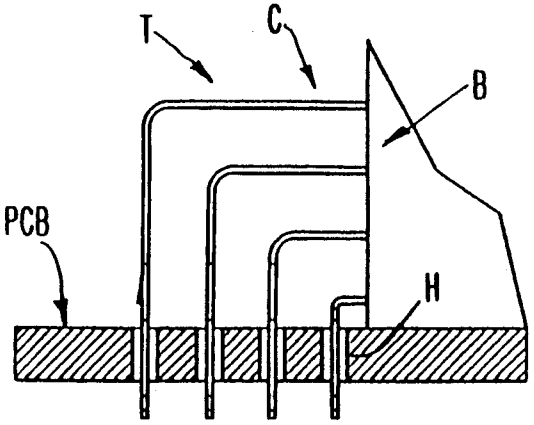
PRIOR ART Fig. 1B
FIG. 1B is a rear elevation view of the connector of FIG. 1A.
Figure 2B:
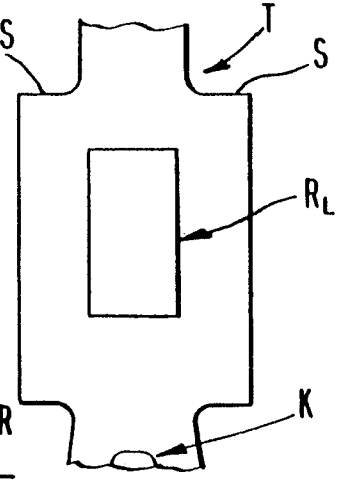
PRIOR ART Fig. 2B
FIGS. 2A and 2B are enlarged views of the circled portions of the tails of the connector of FIG. 1A respectively illustrating the barbed and lanced retention features thereon.
Figure 2A:
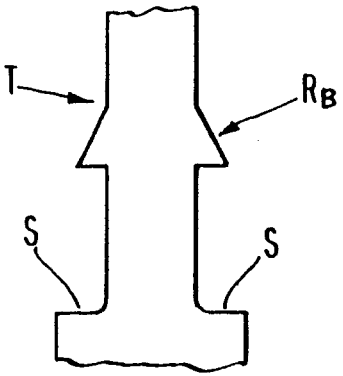
PRIOR ART Fig. 2A

Throughout the following detailed description similar reference numerals refer to similar elements in all Figures of the drawings.

With reference to FIGS. 2 through 6 shown is a combination tool in accordance with the present invention for assembling a composite connector, mounting the composite connector to a board by inserting the tails into openings in the board, and stiffening the board. The tool is generally indicated by the reference character 10.

Figure 3:
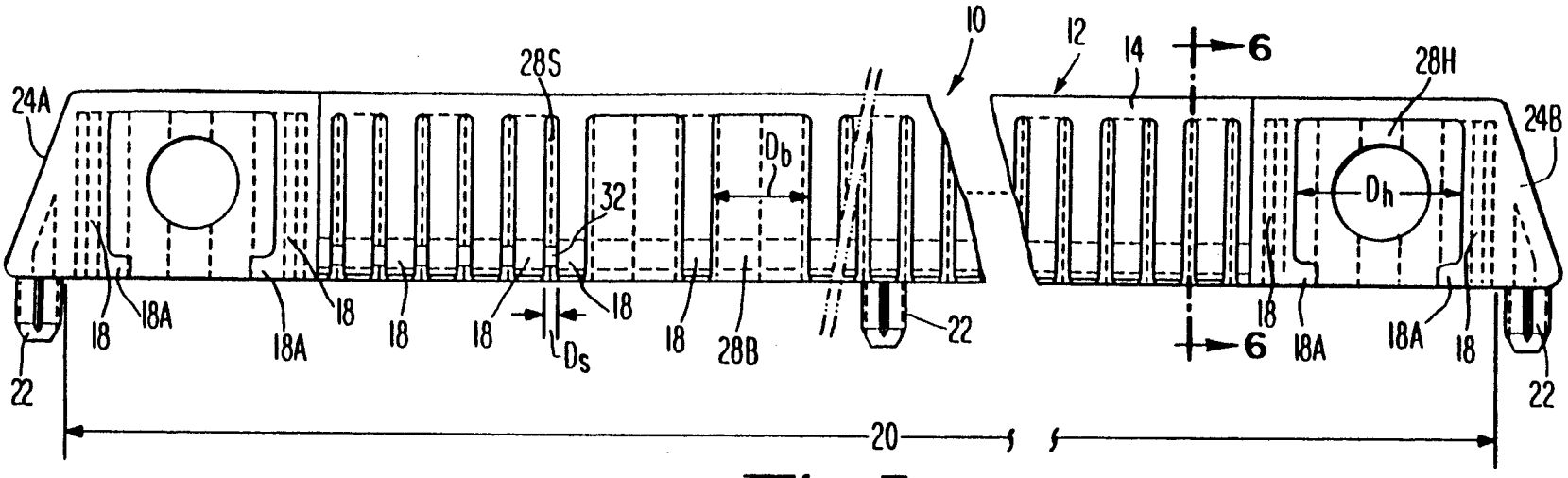
FIGS. 3, 4 and 5 are, respectively, front elevational, bottom and side elevational views of a mounting tool in accordance with the present invention.

The tool 10 comprises a body 12 formed of an insulating material. The body 12 includes a top wall 14, a back wall 16, and a plurality of generally parallel partitions 18. The partitions 18 extend from the top wall 14 and the back wall 16 of the body 12. The body 12 has a predetermined effective transverse length dimension 20 (measured between the end partitions, as shown in FIG. 3).

Mounting members 22 are provided at at least each lateral end of the body 12. In addition, depending upon its effective transverse length dimension 20, one or more additional mounting members 22 may be provided intermediately along the body 12. In the preferred case the mounting members 22 take the form of pegs. In the embodiment illustrated the body 12 has flanges 24A, 24B that extend laterally from the end partitions to increase the length of the body 12 beyond its effective transverse length 20. The mounting members 22 depend from the undersurface of the flanges 24. Alternatively, the mounting members 22 may depend from the bottom surface of the end partitions, or the bottom surface of the back wall 16, as is most convenient. The mounting members 22 disposed intermediately along the body 12 extend from the bottom surface of the back wall 16.

Adjacent ones of the generally parallel partitions 18 formed therein in the body 12 cooperate to define a plurality of slots, each slot being generally indicated by the reference character 28.

Figure 6:
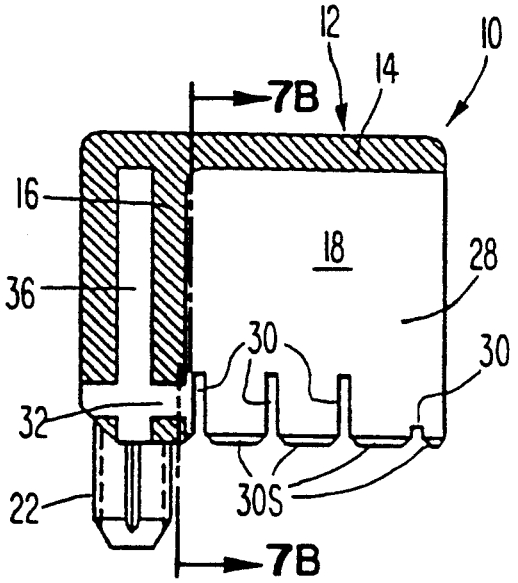
FIG. 6 is a side sectional view taken along section lines 6—6 in FIG. 3.

As is best seen in FIG. 6 each partition 18 has an array of notches 30 formed along the bottom edge thereof. The notches 30 have lead-in surfaces 30S (FIG. 6) adjacent thereto. The purpose of the notches 30 will become more clear herein. In addition, as seen in a portion of FIG. 5 and in FIG. 6, in the most preferred instance the back wall 16 of the body 12 is provided with openings 32 for a purpose to be described. Although the openings 32 are shown to extend completely through the back wall 16, it should be understood that such need not necessarily be the case, it being sufficient that the openings 32 form pockets that communicate with the slots 28.

In the preferred case the tool 10 is fabricated from a thermoplastic polymer material using a molding operation. For considerations associated with the molding process cored openings 36 are formed in the backwall 16, in the end partitions, and at other convenient locations in the body 12.

Figure 4:
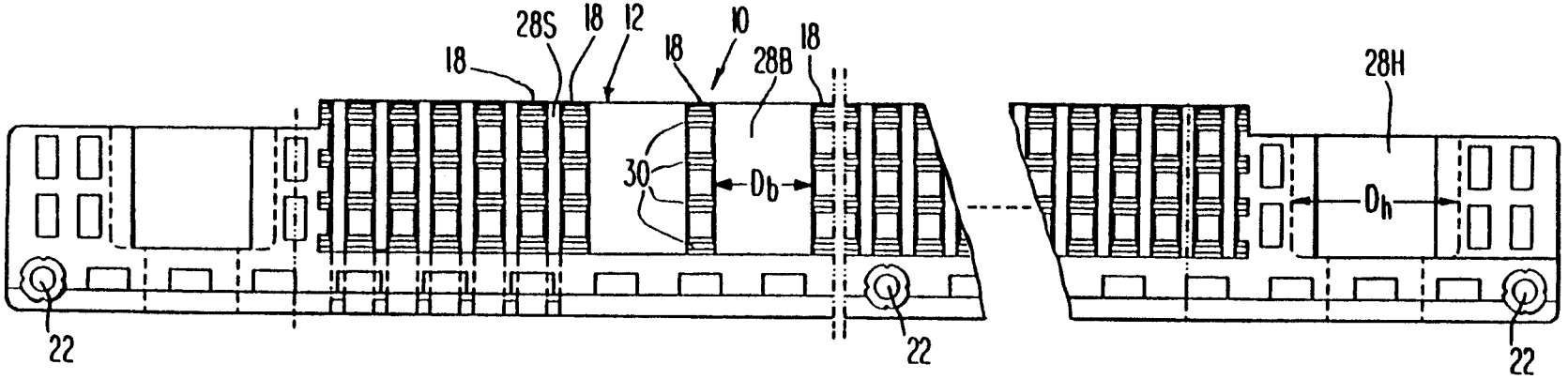
Figure 5:
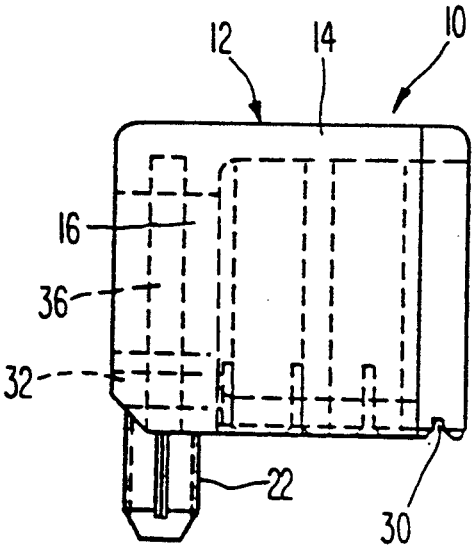

With reference now to FIGS. 3 and 4 it may be appreciated that the slots 28 may have various transverse dimensions associated therewith. For example, a slot such as indicated by the reference character 28S has a predetermined transverse dimension that corresponds in size to the transverse dimension $D_s$ of the tail $T_s$ of a signal transmission terminal. Accordingly, each slot 28S is sized to accept the tails $T_s$ from a group of signal transmission terminals. The notches 30 along the bottom of the partitions 18 defining the slot 28S receive and act against the pushing shoulder S (FIGS. 2A, 2B) on the tail of the signal transmission terminal.

A slot such as indicated by the reference character 28B has a predetermined transverse dimension that corresponds in size to the transverse dimension $D_b$ of the tail $T_b$ of a bladed power terminal. Each slot 28B is thus sized to accept the tails $T_b$ from a group of such terminals, with the notches 30 along the bottom of the partitions 18 defining the slot 28B receiving and acting against the shoulder S (FIG. 1A) on the tail $T_b$ of the bladed power terminal.

A slot such as indicated by the reference character 28H has a predetermined major transverse dimension that corresponds in size to the transverse dimension $D_h$ of the tail of a hybrid terminal. However, as seen in FIG. 3 the lower margin of the partitions 18 defining the slot 28H have confronting arms 18A thereon. Each slot 28H is thus not only sized to accept the tail $T_h$ from a hybrid terminal, but the arms 18A on the boundaries of the slot 28H position the fingers F depending from the tail $T_h$ of the hybrid terminal.

The body 12 shown in the Figures has at least one of each type of slot 26S, 26B and 26H formed therein. It should, of course, be understood that the body 12 may have only one type of slot, any combination of two of the slots, or all three types of slots, depending upon the particular connectors with which the tool 10 is used.

In use, the tool 10 in accordance with the present invention provides several mutual complementary functions.

First, the tool 10 may be used to assemble a composite connector from two or more individual modular connectors. To this end the effective transverse length dimension 20 of the tool 10 may exhibit any convenient length. Preferably the effective transverse length dimension 20 of the tool 10 is, for this purpose, sized as an integer multiple of a basic unit length of the modular connectors being used to form the composite. Such a use is believed especially advantageous to assemble a composite connector from two or more modular header connectors or receptacle connectors such as those sold under the trademark Metral TM header and receptacle modules. However, it should be understood that the effective transverse length dimension 20 of the tool 10 may be determined by the sum of the individual unit lengths of the individual connectors forming the composite.

When assembling a composite connector from two or more individual connectors the tails T of the connectors forming the composite are loaded into an appropriate arrangement of appropriately configured slots 28 provided in the tool 10. Thus, the body 12 of the tool 10 is molded to exhibit the appropriate number and arrangement of slots 28S, 28B and/or 28H to correspond to the sequence of the tails T of the individual connectors forming the composite connector.

As noted earlier, in the case of a hybrid tail the slot 28H has a major transverse dimension that corresponds to the dimension $D_h$ thereof. The arms 26A on the members forming the slot 28H cradle the undersurface of the tail $T_h$ and prevent the connector from falling therefrom.

Figure 7A:
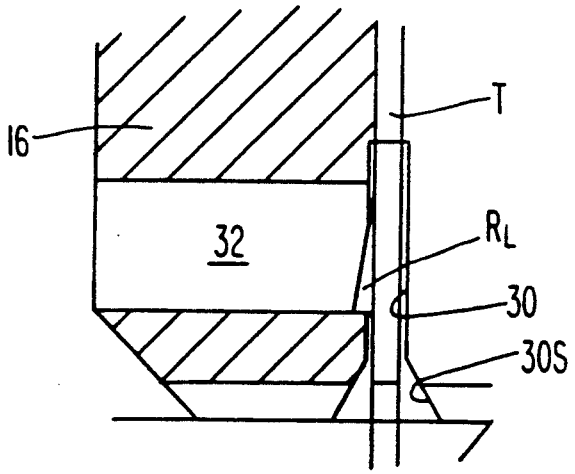
Figure 7B:
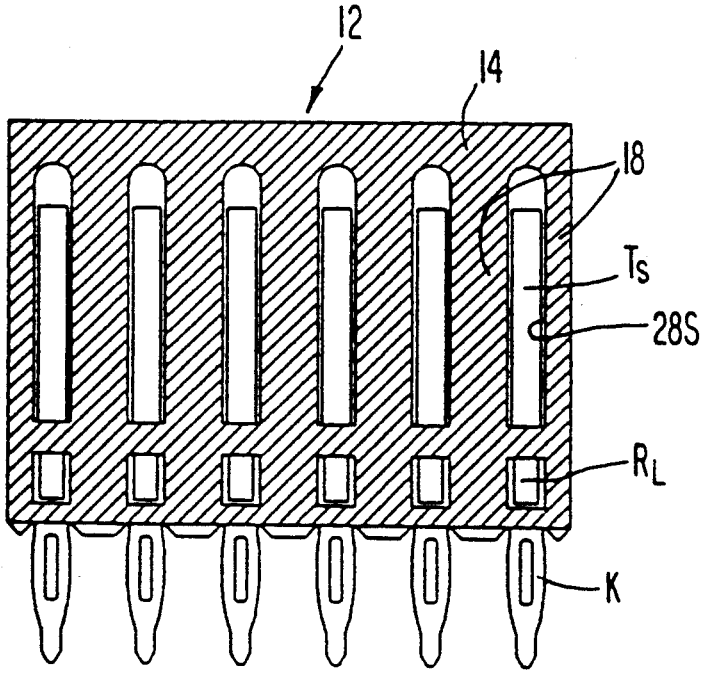
FIG. 7B is a sectional view taken along section lines 7B—7B of FIG. 6 with a tail of a terminal received therein, both illustrating a tail having a lanced retention feature as received in a tool of FIG. 3.
Figure 7C:
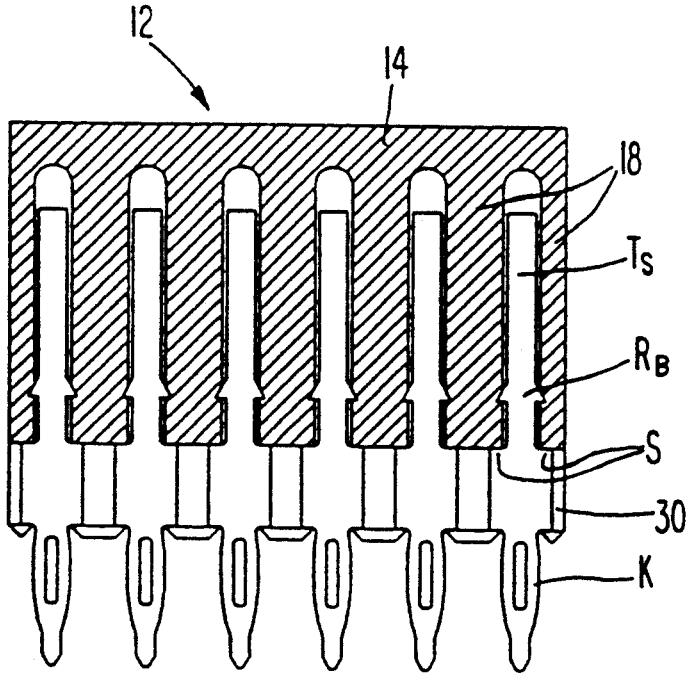
FIG. 7C is a view similar to that of FIG. 7B illustrating a tail having a barbed retention feature as received in a tool of FIG. 3.

In the case of bladed power and signal transmission slot tails $T_b$ and $T_s$, each tail $T_b$ and $T_s$ is held in a respective slot 28B, 28S in the tool 10 using the retention features R provided on the tail itself. For example, as seen in FIGS. 7A and 7B, when the tail is provided with lanced retention feature $R_L$, the lanced portion of the tail is received within the openings 32 formed in the back wall 16 of the body 12. As the tails are inserted into the slots 28 of the tool 10 the lanced portions $R_L$ snap into the openings 32. As seen in FIG. 7C, in the case of a tail having the barbed retention feature $R_B$, as the tails are inserted into the slots 28 the barbed retention feature $R_B$ bites into the material of the partitions 18 defining the slots 28. The tool 10 serves protect the tails from mechanical damage.

In all three instances it should be understood that the tails of the terminals are nonremovably received within the tool 10. Nonremovable, in this usage, denotes the fact that once the tails are loaded the tool 10 cannot be removed from the connectors without damaging the tails of the connector to such an extent that the tails will be deformed and cannot be inserted into a board PCB.

As a second function, the tool 10 having the tails of the terminals loaded therein may be used in the manner of a push block to assist in the insertion of the tails into the board. It should first be noted that the structure of the tool 10 is such as to properly locate the tails, whatever their form, for insertion into the board PCB. If the tails are from signal transmission terminals or bladed power terminals, receipt of the shoulder S in the notches 30 serves to prepare the tails for insertion into the board. In the case of the tail from a hybrid terminal the arms 26A on the members defining the slots 28H accurately locate the fingers F on the tail. Secondly, the tool 10 acts against either the pushing shoulder S on the tail $T_s$ or the tail $T_b$ or the top surface of the tail $T_h$ to impart an insertion force to the tail to cause it to enter the opening in the board.

Finally, the tool 10, by virtue of the mounting members 20, is able to be securely affixed to the board PCB. As a result, the tool 10 serves as a stiffener for the board, thereby to assist in preventing bowing of the same.

Those skilled in the art, having the benefit of the teachings of the present invention as hereinabove set forth may effect numerous modifications thereto. Such modifications as are discussed herein and which appear to those skilled in the art are to be construed as lying within the scope of the present invention, as defined by the appended claims.

What is claimed is:

1. A tool for a connector having a plurality of right angle tails extending therefrom, the tails being arranged in nested groups, the tool comprising:

a body formed of an insulating material, the body having a plurality of partitions therein, the partitions cooperating with each other to define a plurality of slots, each slot being sized to accept a group of tails, each of the tails being nonremovably received within each slot, and a mounting member formed integrally with and extending from the body, the mounting member being adapted to secure the body to a substrate, the substrate having a tendency to bow, the body, when secured to the substrate, serving to stiffen the same and minimize the tendency of the substrate to bow.

2. The tool of claim 1 wherein one of the tails has a lanced portion thereon, and wherein the body has an opening therein that accepts the lanced portion of the tail to nonremovably secure the body to the tail.

3. The tool of claim 2 wherein the tool has a back wall therein, and wherein the opening extends completely through the back wall.

4. The tool of claim 1 wherein an adjacent pair of partitions each has an arm thereon, the arms cooperate to receive and locate the tail of a connector in the slot.

5. The tool of claim 4 wherein the tail of the connector has a pushing surface thereon, and wherein the tool acts against the pushing surface to insert the tail into a board.

6. The tool of claim 1 wherein the tool has a flange extending from each end wall, a mounting member extending from each flange.

7. The tool of claim 1 wherein one of the tails has a pushing shoulder thereon, and wherein one of the partitions has a notch therein that accepts the pushing shoulder therein.

8. The tool of claim 1 wherein one of the tails has a pair of pushing shoulders thereon, and wherein an adjacent pair of partitions each have a notch therein, the notches accepting the pushing shoulders therein.

9. A tool for a connector having a plurality of right angle tails extending therefrom, the tails being arranged in nested groups comprising one of more tails, at least some of the tails having a first transverse dimension while others of the tails have a second transverse dimension, the tool comprising:

a body formed of an insulating material, the body having a plurality of partitions therein, the partitions cooperating with each other to define a plurality of slots, at least one slot being sized to accept a tail having the first transverse dimension, and at least one other slot being sized to accept a tail having the second transverse dimension, each of the tails being nonremovably received within each slot, and a mounting member formed integrally with and extending from the body, the mounting member being adapted to secure the body to a substrate, the substrate having a tendency to bow, the body, when secured to the substrate, serving to stiffen the same and minimize the tendency of the substrate to bow.

10. The tool of claim 9 wherein one of the tails has a lanced portion thereon, and wherein the body has an opening therein that accepts the lanced portion of the tail to nonremovably secure the body to the tail.

11. The tool of claim 10 wherein the tool has a back wall therein, and wherein the opening extends completely through the back wall.

12. The tool of claim 9 wherein an adjacent pair of partitions each has an arm thereon, the arms cooperate to receive and locate the tails of a connector in the slot.

13. The tool of claim 12 wherein the tail of the connector has a pushing surface thereon, and wherein the tool acts against the pushing surface to insert the tail into a board.

14. The tool of claim 9 wherein the tool has a flange extending from each end wall, a mounting member extending from each flange.

15. The tool of claim 9 wherein one of the tails has a pushing shoulder thereon, and wherein one of the partitions has a notch therein that accepts the pushing shoulder therein.

16. The tool of claim 9 wherein one of the tails has a pair of pushing shoulders thereon, and wherein an adjacent pair of partitions each have a notch therein, the notches accepting the pushing shoulders therein.

* * * * *